United States Patent [19]

Luke et al.

[11] Patent Number: 4,651,756

[45] Date of Patent: Mar. 24, 1987

[54] SMOKING ARTICLES

[75] Inventors: John A. Luke, Eastleigh; John F. McCreadie, Southampton, both of England

[73] Assignee: British-American Tobacco Company Limited, Great Britain

[21] Appl. No.: 632,413

[22] Filed: Jul. 19, 1984

[30] Foreign Application Priority Data

Jul. 22, 1983 [GB] United Kingdom ..... 8319845

[51] Int. Cl.[4] ..... A24C 5/60

[52] U.S. Cl. ..... 131/95; 131/284; 131/94; 428/461; 428/464

[58] Field of Search ..... 131/95, 94, 284; 428/461, 464

[56] References Cited

FOREIGN PATENT DOCUMENTS 0545862 6/1942 United Kingdom ..... 131/95

*Primary Examiner*—V. Millin

*Attorney, Agent, or Firm*—Kane, Dalsimer, Kane, Sullivan and Kurucz

[57] ABSTRACT

A method of applying metal foil embellishment to cigarette paper or tipping paper comprises pressing foil against tipping using a heated former of a configuration corresponding to that of the desired embellishment. The method, which is preferably carried out on a filter tip assembly machine, may result in a depression in the tipping, in which case it is advantageous for the tipping to comprise a thermoplastic material.

12 Claims, 2 Drawing Figures

SMOKING ARTICLES

Figure 1:
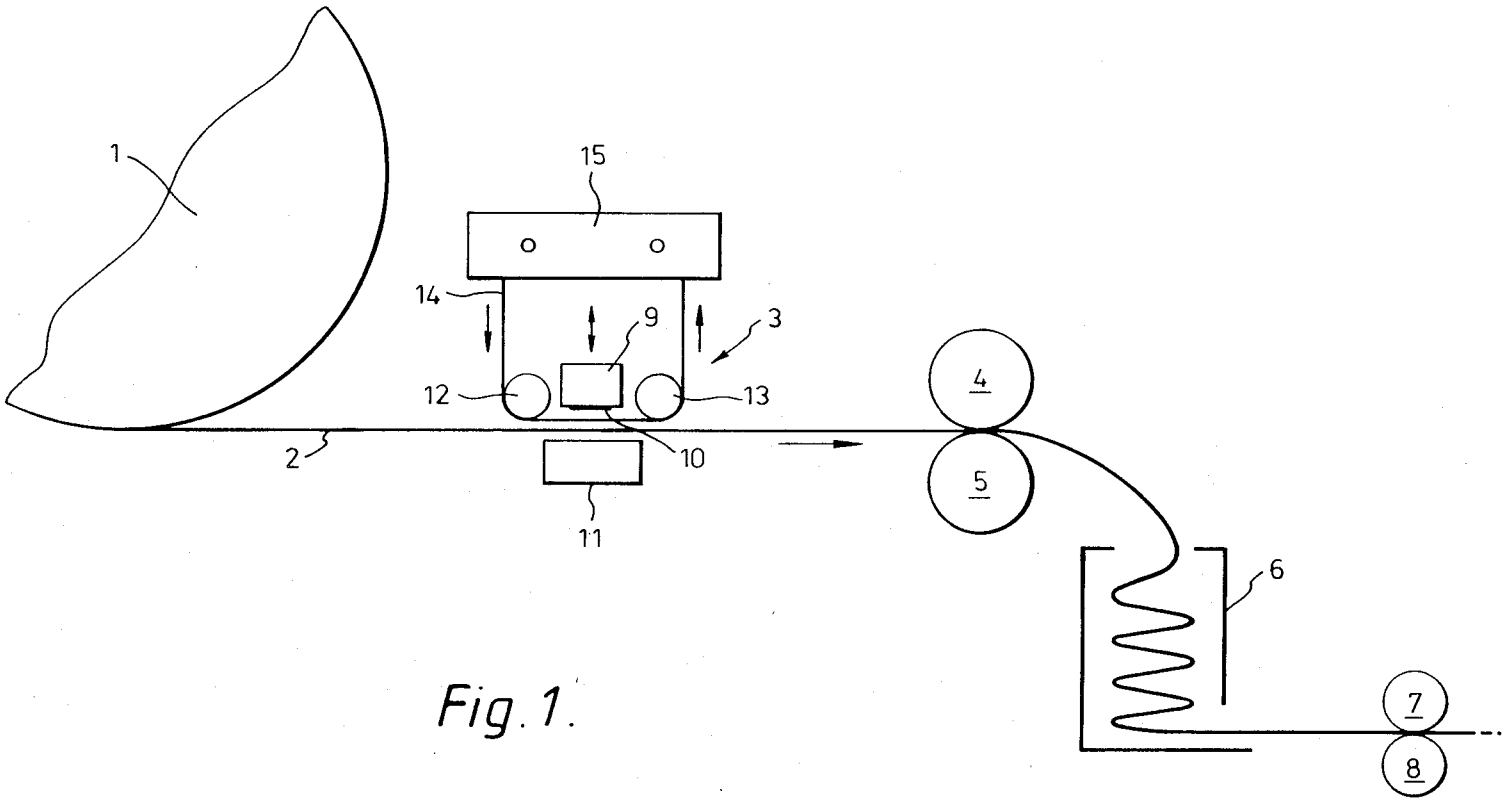

This invention relates to the provision of metallic embellishment on smoking articles, cigarettes for example.

It has long been known to provide a metallic effect on the tipping of tipped cigarettes. A known method of providing such an effect is to apply a metallic ink to the tipping. The area of the tipping to which the ink is applied has however a somewhat matt finish rather than a highly specular one.

Other proposed methods of providing a metallic effect on tipping are by vacuum metallization, the application of metallic powder, bronze for example, to an adhesive imprint on the tipping, and the lamination of a metallic foil and the tipping. Some of these latter methods are employed by the manufacturers of tipping, typically to produce an all-over metallic effect or to provide a line of metal which extends along the length of the tipping web and thus which in the asssembled cigarette, extends circumferentially of the tipping.

It is an object of the present invention to provide a method of imparting a metal foil embellishment to tipping which method results in a highly specular finish and which is capable of providing an embellishment in a required location on the tipping relative to the ends thereof which in the assembled smoking article form a lap seam.

The present invention provides a method of imparting to smoking article tipping metal foil embellishment, wherein tipping and metal foil are brought into contact with each other, pressure is applied to said contacted tipping and foil by means of a former, the pressure application being conducted at elevated temperature and the former acting to cause the metal foil to adhere to the tipping in a configuration conforming to the configuration of the former. The present invention also provides tipping which has been subjected to such a method and a cigarette or other smoking article incorporating tipping which has been subjected to such a method.

Advantageously, the former acts to produce a depression in the tipping and to cause the metal foil to adhere to the tipping within the depression, preferably only in the depression.

Conveniently, during the pressure application the tipping and the foil are disposed between the former and a body of resilient material.

If the former acts to produce a depression, it is disadvantageous, although not impossible, to re-reel the tipping since the depressed portions stand proud of the back surface of the tipping and thus an uneven re-reeling results. Thus, especially if the former acts to produce depressions, it is preferable that the inventive method is carried out with the tipping in a path extending to a location at which the tipping, in discrete portions thereof, is assembled with smoking material rods and smoking article tips.

If the former acts to produce a depression, the tipping should be heat-deformable.

The tipping may be a paper comprising a proportion of thermoplastic material, the presence of which enhances the heat-deforming character to the tipping, which character is necessary in obtaining sharply defined margins of a metal foil lined depression. The thermoplastic material is advantageously incorporated in fibrous form in the furnish from which the paper is made. Alternatively, the thermoplastic may be coated onto the paper or adhered thereto in sheet form. A further alternative is for the tipping to be in the form of a sheet of thermoplastic material. Among the thermoplastic materials which may be utilized in any of these alternatives are cellulose acetate, viscose, polyethylene, polypropylene, nylon and polyethylene teraphthalate.

The necessary heat may be supplied by maintaining the former at an elevated temperature, although alternatively or in addition, the tipping may be heated prior to the formation of the depression.

The metal foil is suitably gold or a gold alloy, although other foils, aluminium or an aluminium alloy for example, may be used.

The metal foil embellishment may take the form of, for example, a trade mark, brand name, emblem or other indicia, and/or take the form of a pattern or decoration which may extend or be repeated around the circumference of the finished smoking article.

Advantageously, the former is mounted on a filter tip assembly machine, i.e. a machine designed to assemble filter tips with cigarette rods by means of tipping wrappers, usually a double length filter element assembled with two cigarette rods, one at each end of the filter element. In this manner it can be readily and reliably arranged for the embellishment to be formed at any desired position relative to the lap seam therein which is made during the assembly procedure.

The invention will now be described, by way of example, with reference to the accompanying diagrammatic drawings, FIGS. 1 and 2 of which show respectively different forms of appartus for applying metal foil embellishment.

In FIG. 1 reference numeral 1 designates a reel of heat-deformable tipping from which extends a tipping web 2. The web 2 extends through the location of a metal foil embellishing unit, generally designated 3, and a pair of drive rollers 4, 5 operable to drive the web 2 intermittently. From the rollers 4, 5 the web 2 extends via a reservoir box 6 to a pair of continuous-drive drive rollers 7, 8 forming part of a filter tip assembly machine, not otherwise shown. Advantageously, the reel 1, unit 3, rollers 4, 5 and reservoir box 6 are all mounted on the filter tip assembly machine.

The unit 3 comprises a vertically reciprocatory former 9 which is provided, at an under face thereof, with a relief impression, indicated at 10, of a logo. The former 9 is also provided with electrical heating element means (not shown) operable to maintain the relief impression 10 at an elevated temperature, a temperature in a range, for example, of 50° C. to 150° C. Beneath the former there is located a fixed, resilient block 11. The unit 3 also comprises drive rollers 12, 13 which are operable to drive intermittently, in concert with the intermittent drive of rollers 4, 5, a metal foil strip 14 extending from a cassette 15.

A run of the foil strip 14 between the rollers 12, 13 extends between the former 9 and the block 11 and overlies the tipping web 2.

In operation of the apparatus shown in the drawing the rollers 7, 8 feed the tipping web 2 in continuous manner to the filter tip assembly machine. The drive of the rollers 4, 5 and 12, 13 is regularly stopped for a short period sufficient for the former 9 to be moved downwardly into co-operation with the resilient block 11 to produce a depression, of the form of the relief impression 10, in the tipping 2 and to be returned upwardly out of engagement with the block 11. The metal foil strip 14 is adhered to a carrier strip which is at the side of the foil strip 14 which faces the tipping web 2. The carrier strip comprises at its outer face a coating of a heat activated adhesive which enables the carrier strip to serve to adhere a portion of the metal foil strip 14 to the web 2 within the depression formed in the tipping web 2, to fully line the depression. The carrier strip further serves to carry the remaining portions of the foil strip 14 back to the cassette 15. In this manner the tipping web 2 is embellished with a series of regularly spaced, highly specular, metal foil logos.

If, as is the usual practice, the filter tip assembly machine operates to assemble double length cigarettes, the tipping web 2 will be of double width. In such case, the former 9 will be provided with two identical relief impressions, whereby the tipping web will be embellished with pairs of laterally spaced logos symmetrically disposed of the longitudinal centre line of the web 2.

Suitably, the rollers 4, 5 and 7, 8, and any further rollers of the assembly machine bearing on the tipping web 2, are annularly relieved in order to avoid the possibility of the rollers causing a flattening of the depressed portions of the tipping web 2.

Figure 2:
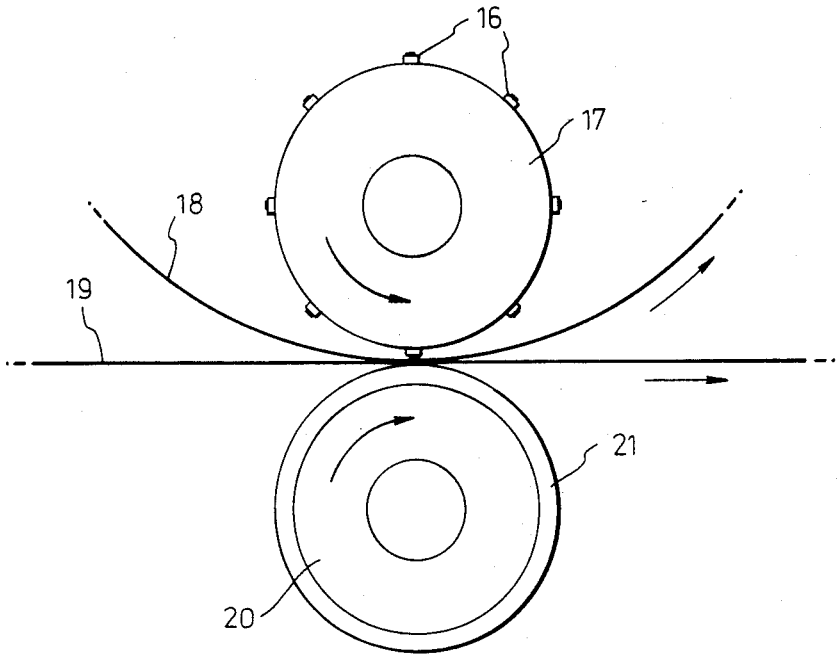

An alternative apparatus for imparting metal foil embellishment to tipping web is shown diagrammatically in FIG. 2. The apparatus comprises a plurality of heated formers 16 equiangularly spaced about a rotary drum 17 operable to bring the formers serially into contact with metal foil 18 which is fed, together with a tipping web 19 between the drum 17 and a rotary drum 20 which comprises a resilient backing surface 21.

Another alternative apparatus comprises a fluted drum, operable to carry cigarettes, suitably double length cigarette assemblies, in the flutes, which type of drum is well known in the tobacco industry, and a reciprocatory heated former located adjacent the drum and operable to cause portions of metal foil to be adhered to tipping of the cigarettes or cigarette assemblies. The reciprocatory former may form part of a unit similar to the above described unit 3. The drum may form part of a filter tip assembly machine.

Although as above described, the former acts to produce a depression in the outer face of the tipping, it could be arranged that the former acts to produce a depression in the inner face thereof. This effect could be obtained using apparatus as shown in the drawing by simply locating the former 9, with the impression 10 uppermost, beneath the web 2, and the block 11 above the web 2.

If the tipping comprises a coating of a thermoplastic material at the outer surface thereof, it may be possible to dispense with an adhesive coating on the foil carrier strip.

Although, as above described, the method of the present invention is applied to tipping, it could also be applied to cigarette paper. For this reason, the term "tipping" in the claims hereof is to be understood to include cigarette paper.

What is claimed is:

1. A method of imparting to smoking article tipping metal foil embellishment, wherein tipping and metal foil are brought into contact with each other, pressure is applied to said contacted tipping and foil by means of a former, the pressure application being conducted at elevated temperature and the former acting to cause the metal foil to adhere to the tipping in a configuration conforming to the configuration of the former.

2. A method according to claim 1, wherein during said pressure application the foil is disposed intermediate the former and the tipping.

3. A method according to claim 1, wherein during said pressure application the tipping is disposed intermediate the former and the foil.

4. A method according to any one of claims 1, wherein the former acts to produce a depression in the tipping and to cause the foil to adhere to the tipping within the depression.

5. A method according to claim 1, wherein during said pressure application the tipping and the foil are disposed between the former and a body of resilient material.

6. A method according to claim 1, wherein the tipping is a paper comprising a thermoplastic material.

7. A method according to claim 1, wherein the former is maintained at an elevated temperature.

8. A method according to claim 1, wherein the former is mounted on a filter tip assembly machine.

9. A method according to claim 1, wherein the foil is adhered to a carrier strip.

10. A method according to claim 9, wherein said carrier strip is at the side of the foil remote from the tipping.

11. A method accordiing to claim 1, wherein the foil carries a coating of a heat activated adhesive at the side of the foil facing the tipping.

12. A method according to claim 1, wherein the tipping at the time of the adherence thereto of the foil is incorporated in a cigarette.

* * * * *